United States Patent [19]

Charles et al.

[11] 4,386,795

[45] Jun. 7, 1983

[54] IDENTIFICATION DEVICE WITH VERSATILE IMPRINTING MEANS

[75] Inventors: Stanley E. Charles, La Canada; Donald A. Long, Burbank; Peter G. Katsenis, Tujunga; Walter W. Mosher, Jr., Granada Hills, all of Calif.

[73] Assignee: Precision Dynamics Corporation, Burbank, Calif.

[21] Appl. No.: 47,282

[22] Filed: Jun. 11, 1979

Related U.S. Application Data

[62] Division of Ser. No. 758,063, Jan. 10, 1977, Pat. No. 4,318,234.

[51] Int. Cl.[3] ..... B42D 15/00

[52] U.S. Cl. ..... 283/5; 283/80; 283/81

[58] Field of Search ..... 40/2.2, 21 C; 283/7, 283/8, 21

[56] References Cited

U.S. PATENT DOCUMENTS

| | | | |
|---|---|---|---|
| 3,965,589 | 6/1976 | McDermott | 40/21 C |
| 4,078,324 | 3/1978 | Wiebe | 40/21 C |
| 4,221,063 | 9/1980 | Charles et al. | 40/2.2 X |

*Primary Examiner*—Paul A. Bell

*Attorney, Agent, or Firm*—Mahoney & Schick

[57] ABSTRACT

An identification device employing a myriad of modes of identifying indicia placement, wherein the device comprises a flexible band having opposed first and second ends wherein the bands may be in severable sheet form and wherein once severed the band is of sufficient length for encircling, captive relationship about an object or person to be identified. A multitude of varous means of securing the first and second ends together is available. Additionally, the availability of a choice of identification means, some of self-imprinting character, provides an identification device which is highly versatile having a plurality of end uses.

11 Claims, 23 Drawing Figures

IDENTIFICATION DEVICE WITH VERSATILE IMPRINTING MEANS

This is a division of application Ser. No. 758,063, filed Jan. 10, 1977, now U.S. Pat. No. 4,318,234.

BACKGROUND OF THE INVENTION

There presently exists a need to be able to identify a variety of objects, things and personnel by means of an expedient which is easy to use, easy to apply and which offers a myriad of choices in information placement, all in a manner which is economically feasible and which results in identification which is tamper-resistant.

The art has proposed various devices for identification purposes, some utilizing flexible bands having envelopes or pockets in which are contained insert cards bearing printed or typewritten indicia with various means of securing the bands to the objects or persons to be identified.

These prior art devices have suffered from several serious drawbacks. The prior art designs have not lent themselves to the placement of indicia which is indelible and tamper-resistant.

Most importantly, however, the consumption of skilled technician's time in typing up identifying indicia and then properly inserting it in the identification band has detracted tremendously from the obvious advantages of such identification devices.

Even so, in some of these prior art devices, the identification indicia, may be removed and substituted with other indicia in such a manner that such exchange is relatively undetectable. Additionally, placement of the identifying indicia requires a sequence of steps, i.e. typing or writing on the insert card, insertion of the insert card in the envelope or pocket of the device and subsequent sealing of the pocket or envelope where security requires it. All of these steps are time consuming and costly. It is highly undesirable to permit a situation where the identification devices themselves or alternately the information contained thereon or therein may be altered by unauthorized personnel, either for criminal purposes or for other purposes where such devices are utilized in medical or general applications.

There are other instances where identification is required which identification should not be easily tampered with or removed, wherein the subject matter to be identified are inaminate objects. Such identification devices should be such that once applied to an object for either warehousing, shipping or other purposes, should not be easily removed or tampered with so as to insure that once the identification process has been accomplished that the likelihood of exchange or substitution of information is unlikely. Provisions of the identifying information must be easily and economically executed in order to reduce the labor costs involved.

The herein disclosed invention provides an identification device for identifying persons and objects which obviate the aforealluded to shortcomings existing in the prior art. A variety of modes of application of indicia is provided, ease of application of that indicia and a device which is easily applied where a variety of alternative securement methods provides selectivity relative to the end use desired.

The identification devices of this invention meet and overcome many of the prior art shortcomings, in that the bands making up the identification devices of this invention in some instances carry self-imprinting means on a surface thereof whereby indicia may be directly imprinted onto a surface of the material making up the band. In one embodiment, the self-imprinting means comprises the micro-encapsulation of indicia marking materials which may include volatile substances. Thus, the need of imprinting on a separate card or piece of paper and the disposition of said card or paper in secure relationship within the band, is no longer necessary. Furthermore, the devices of this invention are provided with one of several means of securing opposed ends of the band in secure relationship. The self-contained identification device is easy to use, economical to produce and fulfills its intended function, all in a manner overcoming many of the shortcomings of prior art devices. Another important aspect of the invention is that the self-imprinted information cannot be removed from the identification band once the self-imprinting step has been accomplished without tell-tale signs thereof.

OBJECTS AND SUMMARY OF THE INVENTION

It is an object of the invention to provide an identification device.

It is still another important object of the invention to provide an identification device employing a myriad of modes of applying identifying indicia.

It is still another more important object of the invention to provide a plurality of identification devices in sheet form for ease of application of identifying indicia.

It is still another more specific important object of the invention to provide identification devices of a specific construction utilizing a variety of modes of placement of identification indicia, which are easy to use and economically feasible.

It is another still even further important object of the invention to provide identification devices wherein said devices are of a construction which permits the use of a tamper-resistant indicia and wherein the devices may be selectively sized and permanently secured by a variety of securement means.

It is still another and still further more important object of the invention to provide a mode of identification which allows easy placement of indicia and facile placement of the identification device on the object, person or thing to be identified.

It is still another even more specific object of the invention to provide identification devices in severable sheet form having overlying self-imprinting means for the pressure transference of indicia to the juxtaposed surface of the individual indentification devices which are removed from the sheet form for encircling placement about an object or person to be identified.

It is still another, specific object of the invention to provide fusion and adhesive securement means on identification devices, not requiring snaps, rivets or other mechanical means to obtain captive, securing relationship of the identification devices with objects, persons or things to be identified.

Basically, in one embodiment, the invention pertains to an identification device comprising the combination of an elongate flexible band having first and second end portions adapted to be juxtapositioned to encircle an object, said first end portion carrying self-imprinting means for imprinting indicia onto a surface of said band, said self-imprinting means comprising at least a layer of micro-encapsulated marking indicia for pressure transference to said surface of said band which is receptive to adsorption, absorption and retention of said marking indicia and means associated with said flexible band for securing said first and second end portions into encircling captive relationship of an object to be identified.

In another embodiment exemplary of the plurality of embodiments of the invention, the identification devices comprise a unitary sheet having a plurality of detachable elongate flexible bands, each of said elongate flexible bands having first and second end portions adapted to be juxtapositioned to encircle an object upon detachment from said unitary sheet. The first end portion has self-imprinting means thereon for imprinting indicia onto an exterior surface of said band, said self-imprinting means being detachably secured to at least a portion of one edge of said unitary sheet approximate said first end portion and comprised of a layer of micro-encapsulated marking material for pressure transference to said exterior surface of said band which is receptive to said marking material and having securement means for securing said first and second end portions of said flexible band once the same is severed from said unitary sheet into encircling captive relationship of an object to be identified.

In some instances, prior art securement means or securement means to which no invention is claimed, may be utilized but in an exemplary embodiment, the first and second end portions of the flexible band may be so fabricated so that no separate mechanical means for securement is necessary but instead, an adhesive bond and even a fusion bonding of the first and second end portions of the flexible band may be obtained so as to be able to position the flexible band in encircling relationship of an object, person or thing to be identified in a permanent and secured manner.

These and other objects of the invention will become apparent when considering the drawings and the herinafter following commentary.

DESCRIPTION OF THE BEST EMBODIMENT CONTEMPLATED

Figure 1B:
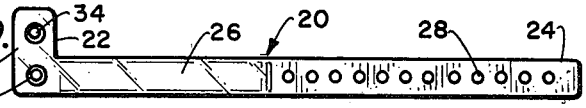
FIGS. 1*b*, 1*c* and 1*d* illustrate still other embodiments of the invention.

While a specific description of the invention for purposes of illustration will be directed to a type of identification device in bracelet form, as, for example, may be found in penal institutions, police-type environments, or medical hospitals, it should be noted that the invention has greater application and field of use and may be employed in other types of uses. For example, the devices may be used to identify inanimate objects for warehousing, transportation or other identification functions.

Furthermore, before the specific description proceeds, it is well to consider the three essential or salient components of the identification devices of this invention in generic terms, it being understood that the three components are the band, the securement means and the identification means, all of which are selectively variable depending upon ultimate end use to provide an identification device of versatile character.

The Flexible Band

Generally speaking, the size of the identification devices of this invention will be dictated by the end use to which the identification devices are to be put. For example, where the identification devices are to be put in encircling securement on a large diameter object, the length of the flexible band will be longer, whereas if the identification devices are to be utilized to identify patients in hospitals or inmates in penal institutions or similar such uses in identifying human beings and depending upon the plurality of apertures and/or securement means being utilized, the flexible band will either be longer or shorter or narrower or wider. However, in a typical case where it is desired to utilize a double row of spaced apertures to receive conventional or other fasteners and wherein it is desired to utilize the identification device in encircling securement about the wrist of a human being, the length of the adjustable band will be between 10-½ inches and 11 inches although shorter and longer lengths may also be utilized. Additionally, in such an instance, the width of the band may typically be between ½ to 1 inch in width although those of ordinary skill in the art will at once recognize that the foregoing dimensions are in no way delimiting of the invention of the identification devices of this invention.

In some instances, the configuration of the flexible band is so-called straight line or linear whereas in some instances the flexible band will have an L-shaped or flexible tab configuration at one end of the flexible band, the purposes of which will become self-explanatory as the specific description proceeds.

While the identification devices of the invention may be individually fabricated, it will be seen from the specific commentary that ideally, it is preferred that a sheet of flexible bands be so fabricated that they are easily removable and separable from the sheet form, the sheet form permitting ease of placement of a plurality of flexible bands in an imprinting means such as, for example, a typewriter, so that upon insertion into a typewriter an individual flexible band may be imprinted thereon and easily removed from the remaining sheet as will become more apparent. In other instances, because of the particular securement means utilized or the specific configuration of the flexible band, it would not be desirable to place the bracelets in an imprinting means such as, for example, a typewriter, but may still be desirable to have such individual flexible bands somehow integrated but easily separable so as to provide an integral sheet which is easily handled.

Generally speaking, the end use to which the identification devices of this invention will be put will dictate the material from which the flexible band is fabricated and will also dictate the quality of that material. For example, if the identification device is to be utilized with regard to human beings, it is desirable to utilize a material which is of medical grade so as not to be toxic or an irritant to the body of a human being. Generally speaking, the material making up the flexible band may be any natural or synthetic material having a tenacious character. By tenacious is meant the ability to withstand tearing or stretching so as to stand up through the rigors of the intended use of the identification devices of this invention.

The material utilized in fabricating the flexible band should be dimensionally stable in the sense that it has a relatively high modulus of elasticity; a relatively low yield strength; a relatively high ultimate strength and if elongated appreciably, visually indicates such elongation. This lessens the risk of the band being unintentionally or purposely removed from the object or person to which has been secured the identification device.

Particularly suitable materials are plastic materials with or without fibrous components. Satisfactory plastic materials are the poly-vinyl chloride plastics and co-polymers thereof and some of the acetate plastics which are known for their dimensional stability and similar characteristics as, for example, non-toxicity, softness and other features making their use particularly suitable for association with human beings without adverse side effects.

Of the natural fibrous materials, such materials as resin reinforced papers, plastic coated papers and the like are also desirable but in the synthetic fibrous materials, a satisfactory material made of polyethylene fibers by an integrated spinning and bonding process wherein the fibers are self bonded by heat and pressure to form a synthetic plastic not requiring binders, sizes or fillers and unplasticized, bi-axially oriented poly-vinyl chloride plastics fulfill many of the criteria of the identification devices of this invention. Where securement by means of adhesion or bonding is desired, the compatibility of the adhesive or fusing solvent and/or chemical must also be considered, i.e. selection of flexible band material matched to adhesive or chemical to achieve bonding without deleterious effects.

In most instances, a band thickness of about 4 to 30 mils will provide sufficient strength to the flexible band. In some instances, the flexible band may be a single ply or layer of material or in other instances, may be comprised of multiple layers. For example, in some instances, a three layer or ply flexible band is desirable in that a single intermediate layer of a self-bonded polyethylene fiber plastic, polyethylene terephthalate sheet or an unplasticized, bi-axially oriented polyvinyl chloride layer interdisposed between two synthetic plastic layers will give the strength and tear resistance to the identification devices of this invention in high security risk environments. In other instances, to ensure additional strength, a dual layer of a fibrous intermediate component of the flexible band will be necessary having two outer layer synthetic plastic layers, so as to provide a dimensionally stable, high strength flexible band.

The selection of the materials used in fabricating the identification devices of this invention will be in major part dictated by the end use to which the identification devices will be put and also means or mode of placement of indicia with association with the identification device in that where it is desirable to utilize an identification mode simply comprising the application of ink, the material of the flexible band which is to receive the identifying indicia should be receptive, as by adsorption or absorption, to the particular fluid, ink or dye used in forming the identifying indicia. In other instances where a pocket, which is subsequently sealed by heat or otherwise, receives imprinted indicia in card form, the type of material of the inner and outer layers or ply will not be as important except where the card insert is to be heat sealed within the pocket.

These selective aspects of the invention will become more apparent as the specific description proceeds and will also be cognizable by those of skill in the art when considering the end use to which the identification devices will be put. For example, if the identification devices of the invention are to be utilized in a hospital environment or in a penal institution environment, the materials making up the flexible band should be resistant to soaps, water, alcohol or similar such types of fluids and/or chemicals which would normally and naturally be expected to come into contact with the identification device.

The Securement Means

The securement means, as the flexible band, is highly selectable depending upon the ultimate end use to which the identification device of this invention will be put. Both mechanical means, such as rivets, snaps etc. and chemical and/or adhesive bonding is contemplated as adequate securement means for the devices of this invention. The securement means should be such so as to impart a high degree of tamper resistance so that the identification device may not be easily removed without complete or total destruction thereof.

The types of mechanical securement means contemplated include conventional and specific designs of rivets and in some instances conventional metal and/or plastic fastening members of the self-locking type which employ a male member and a female member which upon cooperative association, provides a fastener which is highly resistant or tamper proof with regard to effecting disengagement of the male member from the female member. Such types of fastening members are well known in the art and a suitable type of plastic locking securement means found to be suitable is that disclosed in U.S. Pat. No. 3,561,074 for Method of Mounting Fastener Components and Construction Thereof and U.S. Pat. No. 3,551,963 for Self-Locking Snap Fastener. Inasmuch as such fastener components are well known in the art, further detail will not be delved into. But with respect to the unique fastening or securement mechanical members and adhesive and/or chemical bonding securement means which are unique to the practice of the invention, such description will be amplified with regard to the specific description taken in conjunction with pertinent figures of the drawings.

The number and type of securement means will, of necessity, be dictated by the configuration and design of the flexible band of the identification device and as the specific description proceeds it will be obvious that where a multiple aperture is utilized in the flexible band a securement means of multiple character will, of necessity, be required in order to provide adequate and secure placement of the identification device with respect to the object, person or thing to be identified. In some disclosed embodiments, the securement means will be at least of a dual nature so as to provide the strength and tamper-resistant character of the identification devices of this invention and to take advantage of the plurality of receiving apertures adapted to receive the mechanical securement members.

In other instances, where the flexible band utilizes a tab or other than a straight line configuration, the securement means as well as placement with regard to the flexible band will be dictated by these parameters.

In some embodiments, the device is secured by means of pressure-sensitive adhesive creating an adhesive bond between adjacently positioned ends of the band, making up the identification device.

In still another embodiment, a fusion bond is formed wherein the band of material forming the device, is of plastic or plastic-coated nature, wherein a solvent, in micro-encapsulated form is carried on one or both of the end portions of the band, which upon rupture of the capsules, forms a fusion bond. In still another embodiment, a heat-sealable coating, or layer of material, is provided so that the ends of the band may be brought together and conventionally heat sealed.

These and other securement means will become more apparent from the specific commentary taken in conjunction with the drawing illustrating such embodiments.

The Identification Means

Depending upon the end use to which the identification devices of this invention are to be put, the identification means used in conjunction with the identification devices of this invention are susceptible to a high degree of selectivity. In some instances, the flexible band may be formed with a receiving pocket in order to receive inserts to which have already been placed identifying indicia or which subsequently may be acted upon to produce identifying indicia within the pocket. The pocket opening may be inaccessible subsequent to placement of the identifying indicia in the pocket. The pocket opening may be heat sealed or adhesively sealed either before or after the identifying indicia has been provided. In other instances, the insert card may itself be a heat sealable material, or alternatively, paper or cardboard coated with heat sealable material to allow heat sealing within the pocket subsequent to the card's insertion, thereby captively retaining same in the pocket. Obviously, where the pocket concept is utilized, it will be desirable that the upper layer of the flexible band forming the pocket be somewhat transparent or transluscent so as to permit easy reading of the identifying indicia.

Also contemplated in the practice of the invention is a flexible band which itself is adapted to receive identifying indicia on the surface thereof and wherein, if desired, a tamper resistant tape segment is applied over the indicia. The tape segment will tear and lose its integrity upon attempted removal and upon removal may leave a discoloration or stain indicator signalling removal of the tape segment. The surface of the tape segment may also have a tamper indicating pattern on the surface thereof which would also indicate any attempted removal.

Also envisioned in the practice of the invention is the instance where an indicia receiving surface is heat sealingly applied to the first portion of the flexible band, wherein the surface is uniquely receptive to indicia marking media and wherein the surface may have an erasure indicating pattern which will signal any attempted erasure. In some instances, the relative thinness of the applied surface is such that attempted alteration, as by erasure, will completely remove the surface from a discrete area of its application, which will also signify tampering. Obviously, the tamper-resistant type segment as alluded to above may be utilized in conjunction with this embodiment.

The identifying indicia substances may take the form of inks, dyes and other chemicals or fluids as well as solid compounds which are adapted to produce identifying indicia. In some instances, because of the volatile nature of the carriers involved, the identifying indicia fluids or compounds will be micro-encapsulated and placed on at least one ply of the material making up the flexible band and thereafter acted upon to produce the desired identifying indicia. Also contemplated are such marking materials as "NCR" paper of the general type disclosed in the U.S. Pat. Nos. 2,299,693, 2,234,862 and 2,730,456 to Green. As is well known in this type of marking, ink material, substance or chemical is micro-encapsulated in rupturable capsules and adhered to a surface of a paper sheet or the like which upon the application of pressure ruptures the capsules to allow imprinting or marking of indicia or alternately the interreaction of one chemical with another contained on the surface of a juxtapositioned member or layer in order to form the identifying indicia.

Because the marking medium is one necessarily requiring a highly volatile carrier or vehicle solvent, it is preferably micro-encapsulated. These materials are highly indelible and alteration and/or erasure most difficult. Also, the indicia produced by these materials are highly water or solvent resistant and thusly, once utilized to provide identifying indicia, the indicia is not readily alterable or adversely affected by external effects.

The identification means may comprise an area equivalent to the width of the flexible band and may extend in a lengthwise direction a selected distance depending upon the information area provided on the flexible band. Additionally, the area utilized for identifying indicia may be such as to also provide for the placement of an identifying fingerprint of the ultimate wearer or user of the identification device. In some instances, placement of the fingerprint and identifying indicia directly on the surface of the flexible band with or without subsequent overcoverage with a segment of tape will permit viewing of the identifying indicia and will also signal any tampering thereof as by means of erasure and the like. In some instances, the color of the band itself may also serve as identifying indicia in conjunction with imprinted information.

In all instances, the identifying incidia is such that changing, altering or tampering with the indicia becomes readily discernible and indicates that the identification device has been tampered with.

Specific Description

Figure 1A:
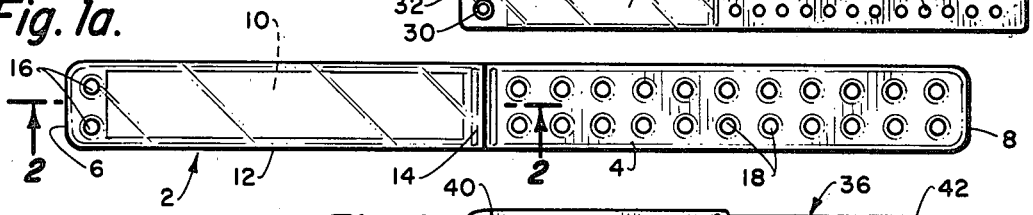
FIG. 1*a* illustrates one of the embodiments of the identification devices of this invention.

Referring to the figures of drawings wherein like numerals of reference designate like elements throughout and referring specifically to FIGS. 1*a*, 1*b*, 1*c* and 1*d*, there is illustrated several different forms and types of identification devices of this invention. In FIG. 1*a*, the device 2 comprises a flexible band 4 of straight line configuration comprising either a single ply or multi ply or layer construction having a first end portion 6 and an opposed or second end portion 8. Spaced from the first end portion 6 is an identifying indicia area 10 in this instance, formed by a transparent segment of plastic 12 heat sealed about its perimeter with the exception of the mouth opening 14 for the reception of identifying indicia. The first end portion 6 has two spaced apertures 16 while the opposed second end portion has a plurality of rows of apertures 18 so that when the first and second end portions are brought into encircling relationship, a securement means, as for example, snap fasteners, rivets or eyelets (not shown) may be secured in aligned apertures 16 and 18 locked in place thereby providing a captively associated identification device with the object, person or thing identified. FIG. 1*b* illustrates a typical L-shaped identification device 20 also fabricated of plastic construction, having a first end portion 22 and an opposed end portion 24 and also provided with a pocket or envelope 26 to receive insert card, imprinting means or other identifying indicia. The device 20 operates in a familiar manner in that once the indicia has been placed within the pocket 26, the second end portion 24 provided with a series of apertures 28, is brought into engagement with a male stud 30 of the first end portion with the flap 32 carrying a female portion 34 of a snap fastener and thereafter brought into engaging relationship with the stud 30 so as to captively retain the end portion 24 in an encircling configuration.

Figure 1C:
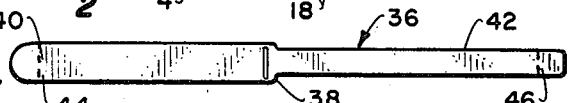

Referring to FIG. 1*c*, another type of identification device 36 is illustrated wherein the flexible band 38 comprises a first end portion 40 and an opposed end portion 42. In this particular instance, a pocket is not utilized but rather the flexible band 38 is fabricated of a plastic which is receptive to the placement directly on the surface thereof of marking indicia such as dye, ink and the like. Rather than utilizing mechanical fasteners as for the devices 2 and 20, in this particular instance, a first end portion 40 is provided with a discrete area 44 and the second end portion 42 is provided with a discrete area 46. The discrete areas 44 and 46 may be coated with a pressure sensitive adhesive which may or may not be of micro-encapsulated type or alternately, may be coated with micro-encapsulated solvent or the like which, when the imposed portions 40 and 42 are brought in over and underlying relationship, the two ends may be pressed together and either adhesively secured or fusion bond secured by reason of either the adhesive or particular solvent which permits bonding of end portion 40 to end portion 42. Where pressure sensitive adhesive is utilized in order to form the securement, appropriate protective coverings may be placed over the adhesive layer and removed when sealing engagement is desired. Obviously, one need not use both of the discrete areas 44 and 46 but rather one or the other of these areas may be utilized for either the pressure sensitive adhesive or the micro-encapsulated solvent coating.

Where one or both of the discrete areas 44 and 46 have applied thereto micro-encapsulated solvent for subsequent pressure application rupturing of the capsules to form a fusion bond, the solvent for human application should be non-toxic. The particular solvent chosen will depend upon the materials utilized for the band 38 and in such instances, a fusion bond will be formed making the bond stronger than the material making up the band 38. In some instances, an adhesive forming material may be micro-encapsulated which forms a bond in and of itself or in conjunction with an adhesive reactant micro-encapsulated on the opposed end 40 of the identification device 36.

In some applications where safety precautions are not of undue concern, and where the flexible band 38 comprises poly-vinyl chloride polymer and copolymer thereof or one of the acetate plastics, a suitable solvent such as acetone is micro-encapsulated and applied to one or both of the discrete areas 44 and 46.

In all cases, however, it is intended upon the application of pressure as by squeezing or running a thumb nail or finger across the discrete area that the micro-capsules are ruptured releasing the solvent, adhesive or reactant to form a bond between the juxtapositioned first and second ends 40 and 42 respectively. Where the flexible band 38 is made of natural fibrous materials, the end or discrete area 44 or 46 may be coated on one or both surfaces with a film of, for example, poly-vinyl chloride and likewise, the opposed end may have such a coating along with the solvent encapsulated layer, the solvent being reactive with the poly-vinyl chloride or other plastic coatings or materials chosen.

Figure 1D:
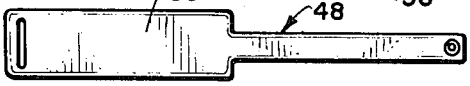

Referring to FIG. 1*d*, another identification device such as a luggage tag 48 is illustrated having the typical flexible band construction and providing an identification area 50 to which identifying indicia may be placed. As the description proceeds herein, it should be understood that the various devices described thus far are merely to illustrate the wide application of use to which the attributes of the invention may be put and one of ordinary skill in the art will recognize from the following commentary that various aspects of the invention may be applied to a myriad of identification devices.

Figure 2:
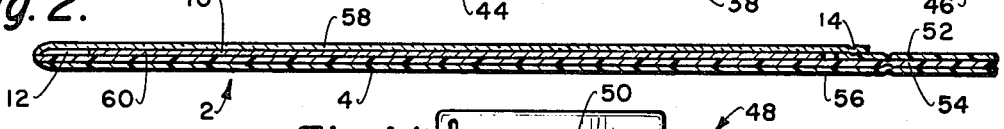
FIG. 2 is a view taken along the line 2—2 of FIG. 1*a;*

Referring now to FIG. 2, the device 2 is illustrated with a flexible band 4 having a first synthetic plastic layer or ply 52 with an intermediate layer 54 of high strength character such as biaxially oriented unplasticized poly-vinyl chloride, polyethethylene terephthalate sheet or self bonded polyethethylene fiber plastics and while one ply or layer 54 is illustrated, in some environments such as high security risk ones, multiple stiffening layers are utilized. The bottom layer 56 may be of the same material construction as the layer or ply 52. In the device 2, an identification area 10 in this instance, is formed as pocket 12 defined by the upper surface of layer 54 adjacent transparent plastic layer 58. Placed in pocket 12 in the indicia carrying area 10 may be insert card 60 to which identifying indicia has been typewritten or otherwise placed thereon. In some instances, the insert 60 may be of the type containing micro-encapsulated ink or dye in which event the pocket 12 may be sealed as by heat, adhesive, or otherwise along the mouth opening 14. The insert 60 may also be heat sealable or have a heat sealable plastic layer thereon for fusion bonding to the plastic layer 54 and/or opposed undersurface of transparent plastic layer 58.

Where the insert carries micro-encapsulated dye or other marking material on the upper surface thereof so that any indicia would be readable through the transparent layer 58 the application of pressure by means of stylus, imprinter or similar such methods may produce identifying indicia on the undersurface of transparent layer 58 and accordingly, the transparent layer 58 should be of a material which is compatible with the particular ink, dye or marking material. Even if the pocket opening 14 is not sealed, the identifying indicia has been indelibly transferred and thus, is not removable for tampering or changing. In some instances it may be found desirable to insert the card 60 having a coating of micro-encapsulated ink or dye on its undersurface through the pocket opening 14, the pressure transference of identifying indicia accomplished, the insert removed so that identifying indicia is imprinted on the upper surface of layer 54 juxtaposed the transparent layer 58. Thereafter, if desired, the mouth opening 14 may be closed as previously described. In other instances the imprinting means is retained within the pocket and the identifying indicia formed on the surface thereof by pressure application, as alluded to hereinbefore, and is retained in the pocket.

Figure 3:
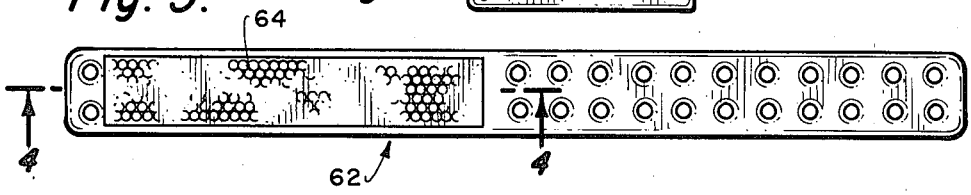
FIG. 3 illustrates another embodiment of the identification devices of this invention.
Figure 4:
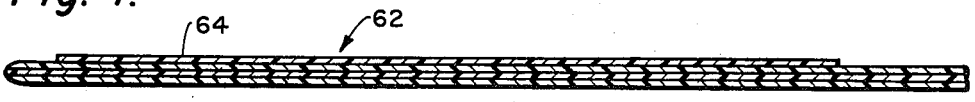
FIG. 4 is a view taken along the line 4—4 of FIG. 3.

Referring to FIGS. 3 and 4, an identification device 62 is illustrated which is similar in construction to the device 2 previously described with the exception that instead of having a pocket formed as an integral part of the flexible band, the upper ply or layer of the band is such that it is adsorbent or absorbent to ink, dye or other marking media and which may receive the printed or written indicia directly thereon and thereafter, a tape segment which may be transparent or translucent secured over the imprinted indicia as by means of adhesive or heat seal so as to make some non-removable. In other instances, and as illustrated in FIGS. 3 and 4, an indicia receiving surface 64 is applied to the identification area of the device 62 either by adhesive securement, hot stamping or transferring or heat sealing securement wherein surface 64 itself is receptive to the ink, dye or other media and wherein the surface 64 may be erasure indicating by means of the design or pattern, as illustrated, which prohibits alteration of the identifying indicia subsequently placed on the surface 64.

Figure 5:
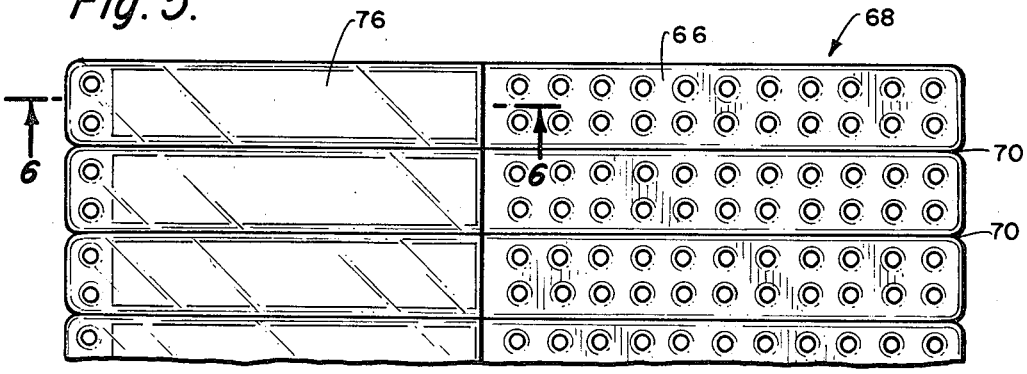
FIG. 5 is a fragmented view showing another embodiment of the invention wherein the identification devices are in sheet form.
Figure 6:
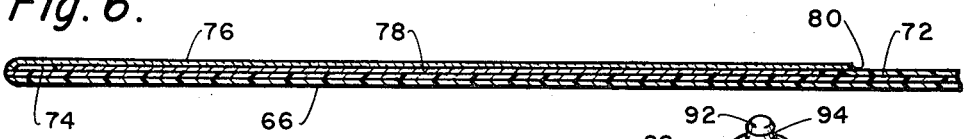
FIG. 6 is a view taken along the line 6—6 of FIG. 5.

Referring to FIGs. 5 and 6, there is illustrated another form of identification device wherein the individual identification device 66 fabricated along the lines described with regard to the FIG. 1*a* embodiment, is provided in sheet form 68 wherein the sheet form 68 is such that a plurality of individually separable identification devices 66 is made possible by reason of having frangible junction lines 70 intermediate individual devices 68. In this instance, the upper surface of layer 72 is ink, dye or other marking media receptive and there is provided in the pocket 74 formed by transparent plastic segment 76 a strip or segment 78 of carbon or NCR type paper having micro-encapsulated dye or ink on a surface thereof so that upon pressure transference of marking indicia, for example, to either the surface of layer 72 or the under surface of pocket covering 76 the insert 78 may be removed or alternately, where it is contemplated to have the under surface of transparent layer 76 carry the identifying indicia, it may be retained therein and the pocket opening 80 sealed as by adhesive or heat seal thereby preventing alteration or tampering with the printed indicia.

Figure 6A:
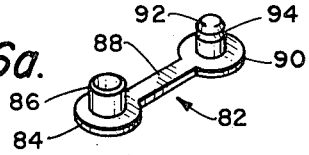
FIG. 6*a* is a perspective view illustrating an alternate securement or fastening means of the identification devices of the invention.

In FIG. 6*a* is illustrated a lanyard plastic lock snap fastener 82 which may be utilized with one or more of the identification devices of this invention, wherein the fastener 82 has a female portion 84 with a protruding female portion 86 with a connecting lanyard or rib 88 integrally secured to male portion 90 having an upstanding male stud 92 provided with a split end conical configuration 94 for captive association with female portion 86. For example, in the use of the snap fastener 82 as, for example, in the device 2, two such fasteners 82 would be utilized with the male stud portion 92 of each of the fasteners being positioned in the apertures 16 and once the second end portion 8 of the flexible band had been positioned and more particularely the selected aligned apertures 18 therein over the fastener, the other component may be brought to overlying relationship and the male-female engagement made which would thereby lock the first and second end portions of bracelet 2 firmly together in a manner well known in the art.

Figure 7:
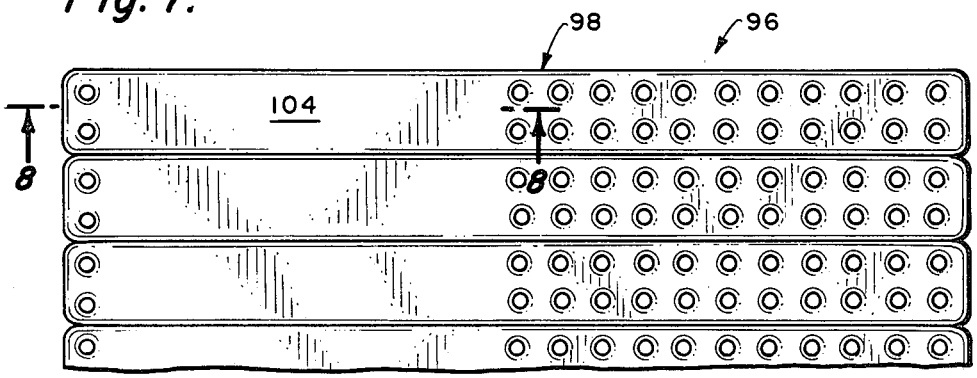
FIG. 7 is a fragmented view illustrating another embodiment of the invention.
Figure 8:
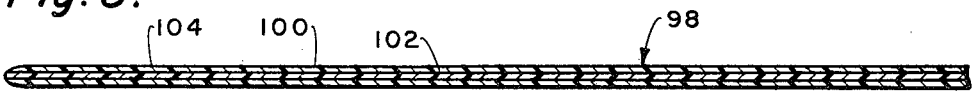
FIG. 8 is a view taken along the line 8—8 of FIG. 7.

Referring now to FIGS. 7 and 8, there is illustrated identification devices of the invention in sheet form 96 wherein the individual identification devices 98 are fabricated of a multi-ply or layered construction as previously described and wherein the upper surface 100 of the ply 102 is ink, dye or marking media receptive, thereby forming an identification receiving area 104 which may be directly written upon or otherwise have indicia imparted thereto.

Figure 9:
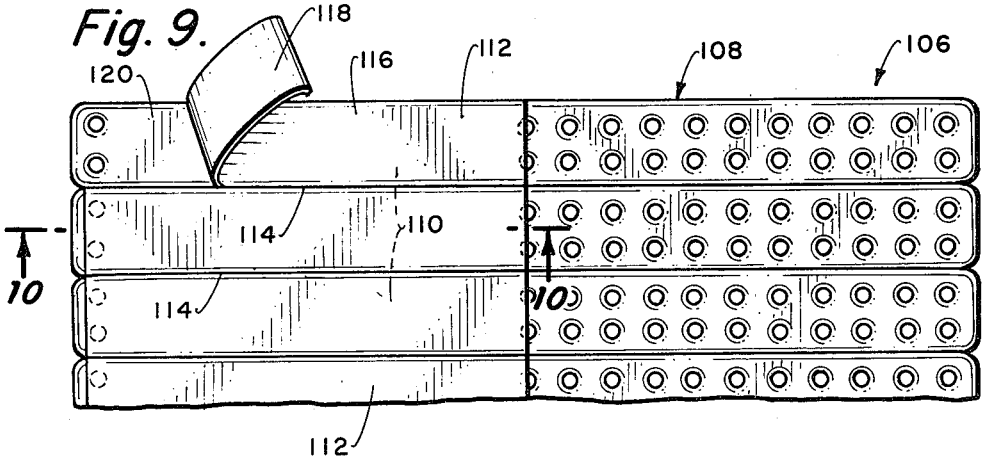
FIG. 9 is another fragmented view of still another embodiment of the invention.
Figure 10:
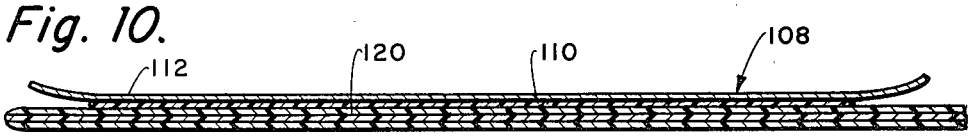
FIG. 10 is a view taken along the line 10—10 of FIG. 9.

Referring to FIGS. 9 and 10, there is illustrated a sheet form 16 having individual severable identification devices 108 wherein overlying the identification receiving areas 110 of the individual devices 108 is a paper or plastic sheet 112 perforated or otherwise scored along the junctures 114 so as to make individually removable segments 116 wherein the under surface 118 of the overlying sheet 112 is provided with micro-encapsulated corrosive ink, dye or other marking material, so that pressure application corresponding to the identifying indicia will permit pressure transference of marking indicia to the upper surface 120 adjacent the individual movable segments 116. The sheet form 112 may be simply positioned in loose fashion over the sheet form 106 and more specifically, the identifying indicia areas 110 or may be secured in a manner which will be described.

Figure 11:
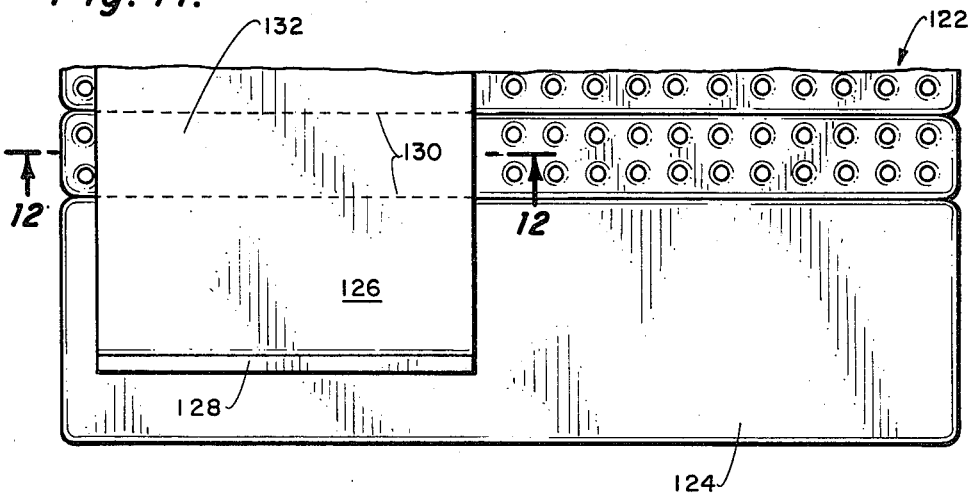
FIG. 11 illustrates a sheet form of the identification devices of this invention with another self-imprinting means.
Figure 12:
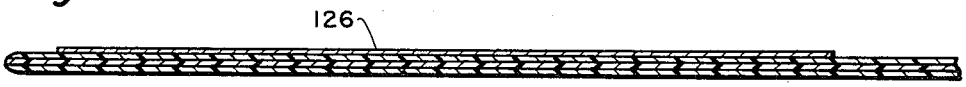
FIG. 12 is a view taken along the line 12—12 of FIG. 11.

Referring to FIGS. 11 and 12, a sheet form 122 is illustrated wherein the bottom portion 124 of the sheet provides a bottom border of sufficient width for retention by, for example, a typewriter and wherein the carbon transfer sheet or other plastic or paper sheet containing micro-encapsulated marking media is adhered to the sheet 122 by reason of the imprinting means 126 being secured as at 128 by means of adhesive or heat sealing where the imprinting means 126 is either plastic or has been coated at least on the under surface so as to permit heat sealing at the area 128. This securement of the imprinting means 126 to the sheet 122 provides an integral unit sufficing for the pressure transference of identifying indicia to the indicia carrying portions of the individual severable identification devices making up the sheet 122 and the imprinting means 126 again may be perforated or have frangible junctures as at 130 to provide for individually removable segments 132.

Figure 13:
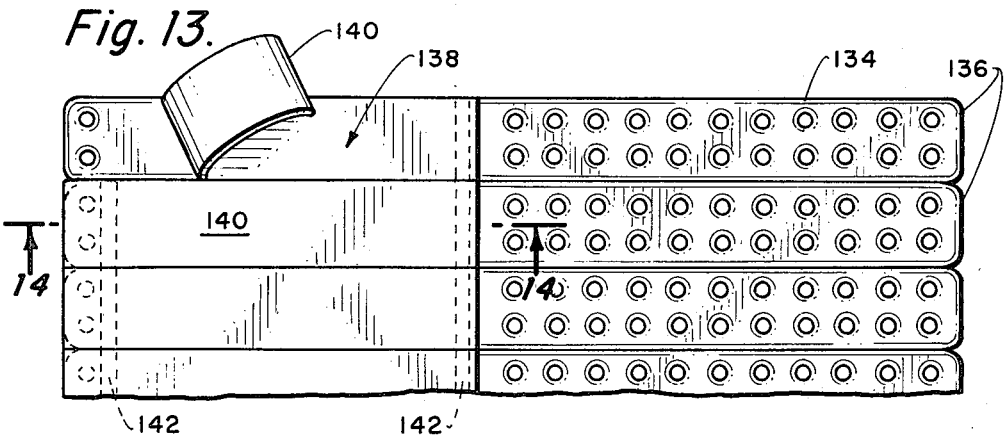
FIG. 13 illustrates still another embodiment of the identification devices of this invention in sheetlike form.
Figure 14:
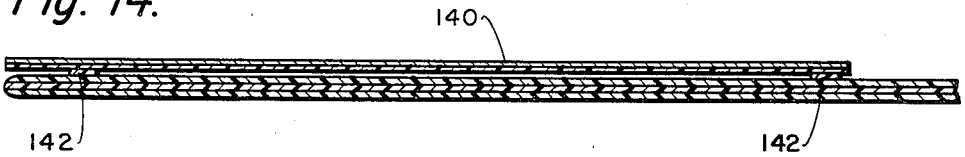
FIG. 14 is a view taken along the line 14—14 of FIG. 13.

Referring to FIGS. 13 and 14, there is illustrated another sheet form of the invention comprising individually severable bracelets 136 wherein the imprinting means comprises a sheet 138 again having individually severable or removable segments 140 and wherein the imprinting means sheet 138 is secured to sheet form 134 by means of adhesive or glue strips 142 running the length of sheet 138. Upon insertion of the sheet 134 into a typewriter or the like by means of a leading edge as described with regard to FIG. 11, the individual identification devices 136 are so positioned so that the indicia carrying areas thereof may be provided with indicia by reason of the self-imprinting means or sheet 138. Thereafter upon pressure application and when no longer needed the individual segment 140 is removed along with severance of the individual identification device from the remainder of the sheet form 134.

Figure 15:
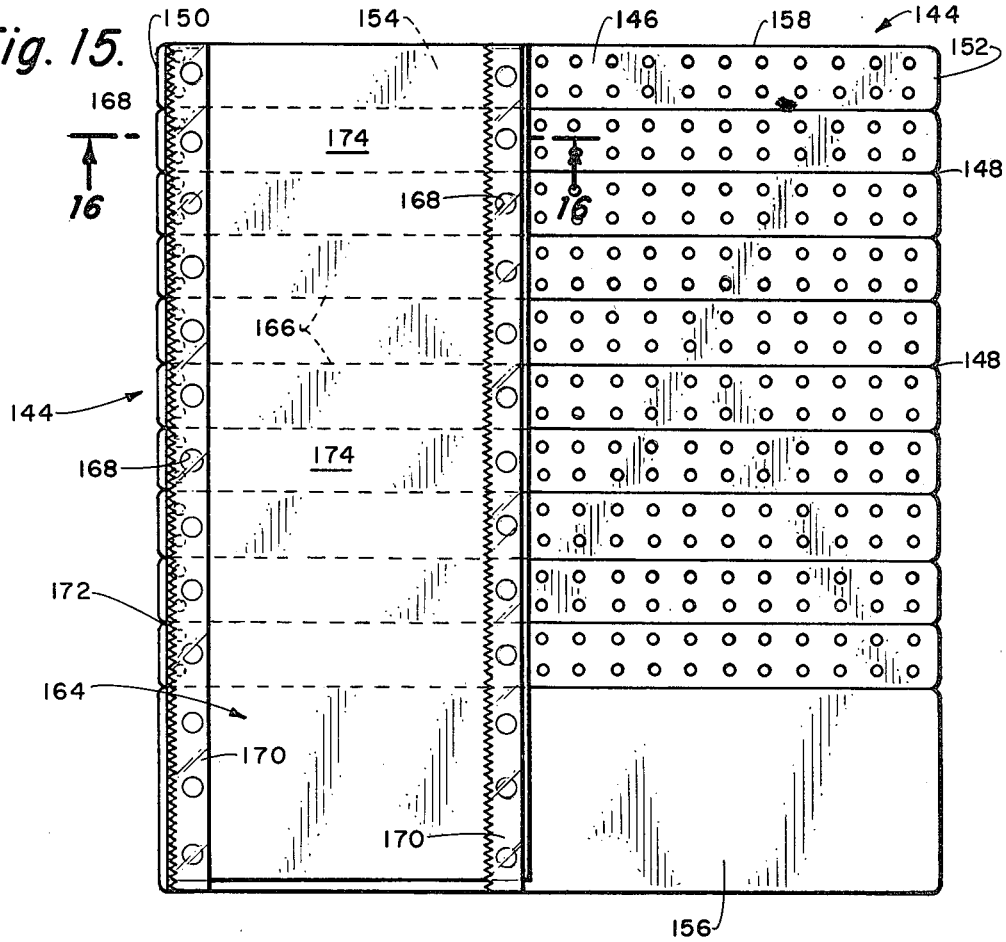
FIG. 15 is an overall view of one embodiment of the sheet form of the invention illustrating another mode of using self-imprinting means in conjunction with the identification devices of this invention.
Figure 16:
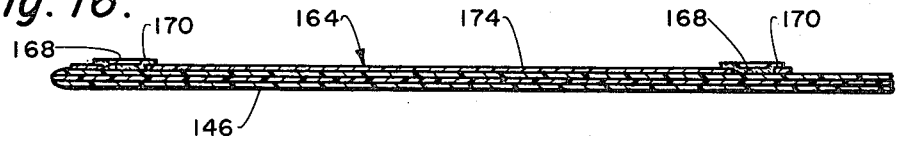
FIG. 16 is a view taken along the line 16—16 of FIG. 15.
Figure 17:
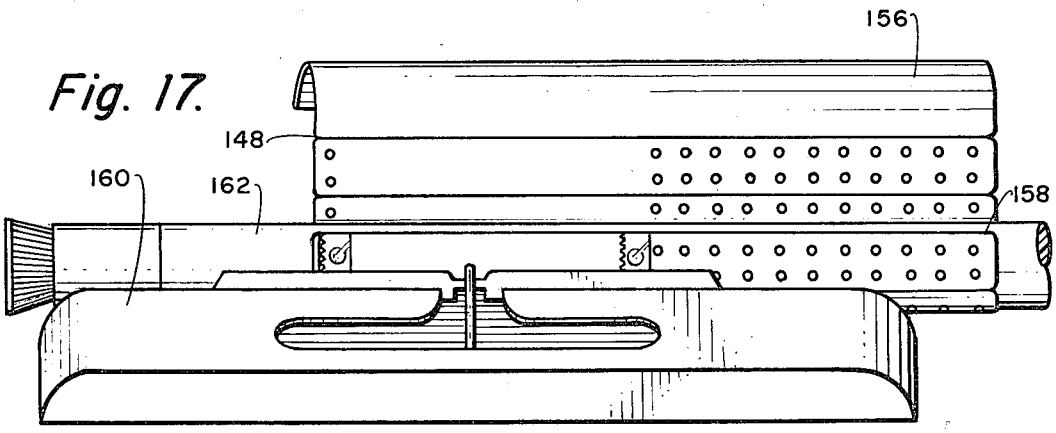
FIG. 17 illustrates how the sheetlike forms of the invention as illustrated in FIG. 15, for example, may be positioned in a typewriter for placement of identification indicia on the one embodiment of the identification device of this invention.

Referring now to FIGS. 15, 16 and 17, there is illustrated sheet form 144 comprising a series of individually severable identification devices 146. As indicated hereinbefore, the individual identification devices 146 are severable from the sheet 144 by reason of the plurality of frangible juncture lines 148 formed by heat sealing and the like. The individual identification devices 146 again have first end portion 150 with a second end portion 152 with identification receiving area 154. The sheet 144 is provided with a blank terminal portion 156 and a leading edge 158 which permits the sheet 144 to be fed into a typewriter, for example, 160 or other imprinting device, so that the individual indicia receiving areas 154 may be imprinted upon by means, for example, of the typewriter elements not shown of typewriter 160. The portion 156 permits retention and aids in the loading of a sheet 144 wherein the majority of the individual devices 146 have been removed from the full sheet. In some instances, the border may be dispensed with and the imprinting means sheet extended beyond the identification device sheet to act as the tailing edge to obtain the same end results as is obtained in having a blank or border portion in the identification device sheet form. The width of the blank portion or border 156 should be such that ample surface contact between the roller 162 of typewriter 160 and the adjacently positioned flexible bands 146 nearest the blank portion or border 156 is obtained and is frictionally secured in retained position within the feed roll 162 of typewriter 160 during the indicia printing process.

In this particular instance, the self-imprinting means or sheet 164, again having its under surface provided with the micro-encapsulated ink, dye or other marking material and being perforated or otherwise severable along the lines 166 so as to make for individually removable segments, is provided with a pair of spaced apertures 168 along the length thereof and put in overlying relationship intermediate the first and second ends 150 and 152 of the flexible bands making up the identification devices 146. Thereafter strips of tape 170 are placed over the apertures 168 and pressed downwardly so that the imprinting sheet means 164 is secured to the sheet form 144 by means thereof. The tape strip 170 adjacent the first end portion 150 may have serrations as at 172 to ensure ease of separation and the removal of individual bands 146 from identification band sheet 144. Thereafter, the individual segment 174 is removed from the band 146.

The sheet form of the invention as described herein and particularly with regard to FIGS. 15–17 inclusive, need not necessarily be utilized with an imprinting device such as a typewriter but may be utilized individually for the placement as, for example, by handwriting of indicia onto the indicia receiving portion of the identification devices. In such event, the sheet form of the invention need not carry the blank or border portions which would be required for utilization in, for example, a typewriter. In the form of the invention illustrated in FIGS. 15–17 inclusive, the sequence of utilization of the identification device would be to feed the sheet form 144 by its leading edge 158 into the typewriter 160 and more particularly the feed roll 162. The necessary identifying indicia would be typed directly onto the identification areas 154 of the identification devices 146 and the individual bands or identification devices would then subsequently be removed from the remainder of the sheet with the remaining identification devices of the sheet being available for future use.

After removal of the imprinting means segment, the individual identification device 146 would then be in a position to be placed in securement around a person, thing or object to be identified utilizing either rivets, snap fasteners or the adhesive or solvent fusion technique previously alluded to. Even though specific securement means have been illustrated with regard to the various forms of the invention, it should be clear that any combination of imprinting means and securement means may be varied for particular need and end results.

Figure 18:
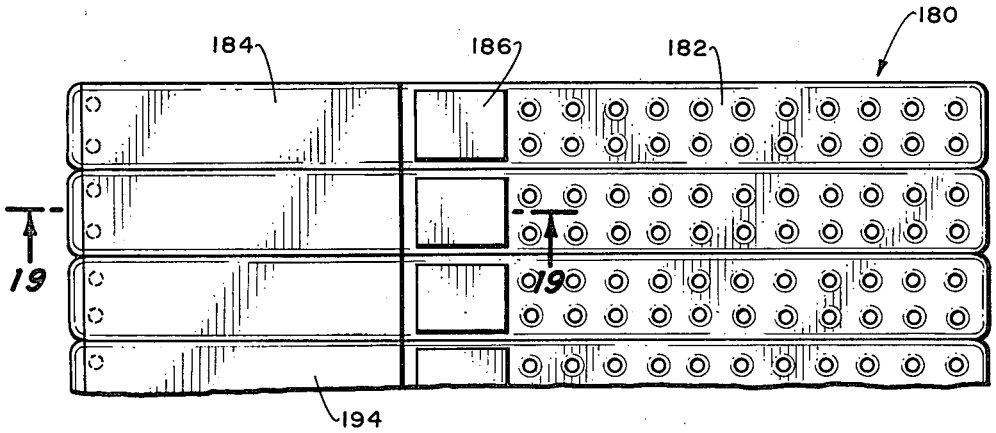
FIG. 18 is a plan, fragmented view of another embodiment of the invention.
Figure 19:
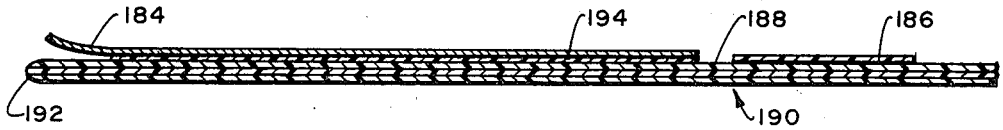
FIG. 19 is a view taken along the line 19—19 of FIG. 18.

Referring to FIGS. 18 and 19 another embodiment of the invention is illustrated. Herein, for example, sheet form 180 having individual identification devices 182, as previously described, is provided with imprinting means 184 overlying the sheet from 180 and more particularly the indicia receiving surfaces thereof. The imprinting means 184 may be disposed in relation to sheet form 180 by any of the means previously disclosed.

In this instance an indicia receiving surface 186 is hot stamped or otherwise applied to the surface 188 of individual bracelet 190. The surface 186 may be of shorter length as shown or may extend towards first end portion 192. However, as shown, an additional hot stamped surface 194 is affixed in the usual indicia receiving area to the surface 188 of bracelet 190. In some instances a single, extending length of hot stamped surface material may be utilized or several segments as shown may be used. In other instances, the segment 186 or 194 may be dispensed with the only one or the other used. Obviously, when the receptive surface, for example, 194, is not utilized, the surface 188 of bracelet 190 should be receptive to the indicia marking materials used and in particular to the material encapsulated and retained on the under surface of indicia marking means 184.

The hot stamped segments 186 and/or 194 are particularly receptive for receiving finger prints or other identification indicia. The identification marking means 184 may extend length wise if desired to overlie hot stamped segment 186 and may even extend over the end portion 192 of bracelet 190 or sheet form 180.

The identification devices of the invention have been described with some particularity but the specific designs and constructions disclosed are not to be taken as delimiting of the invention in that various obvious modifications will at once make themselves apparent to those of ordinary skill in the art, all of which will not depart from the essence of the invention and all such changes and modifications are intended to be encompassed within the appendant claims.

We claim:

1. In an identification device, the combination of: an elongate, flexible band having first and second end portions adapted to be juxtapositioned to encircle an object, said first end portion comprising at least one layer of plastic material, self-imprinting means adjacent a surface of said plastic material layer for imprinting indicia onto said surface of said layer and means for releasably retaining said self-imprinting means adjacent said surface, said self-imprinting means comprising at least a layer of micro-encapsulated marking substance for pressure transference of said indicia to said surface of said plastic material layer and said surface of said layer being receptive to absorption, absorption and retention of said marking indicia, and means associated with said flexible band for securing said first and second end portions into encircling captive relationship of an object to be identified.

2. The identification device in accordance with claim 1 wherein said first end portions of said flexible band includes a pocket portion and said self-imprinting means is encompassed in said pocket.

3. The identification device in accordance with claim 2 wherein said pocket portion is heat sealed to said first end portion of said flexible band.

4. The identification device in accordance with claim 2 wherein said self-imprinting means comprises at least one heat sealable surface for heat sealing engagement within said pocket.

5. An identification device comprising the combination of an elongate flexible band having first and second end portions adapted to be juxtapositioned to encircle an object, said first end portion comprising upper and lower layers of plastic material having confronting lower and upper surfaces respectively and being bonded together to form an open-ended pocket, said upper layer of plastic material being transparent; self-imprinting insert means for imprinting identifying indicia carried within said pocket, said self-imprinting insert means having on at least one surface thereof micro-encapsulated marking substance for pressure transference of indicia to at least one of said confronting lower and upper surfaces of said respective upper and lower layers of plastic material, said at least one surface being receptive to adsorption, absorption and retention of said indicia; and securement means for securing said first and second end portions of said elongate flexible band in encircling, captive relationship of an object to be identified.

6. The identification device in accordance with claim 5 wherein said open-ended pocket is formed of transparent, heat sealable plastic sealed to the upper surface of said elongate, flexible band except at the open-end thereof.

7. The identification device in accordance with claim 5 wherein said end portions of said flexible band are adapted to be fusingly bonded to each other.

8. The identification device in accordance with claim 5 wherein said second end portions of said flexible band is provided with a plurality of spaced apertures in parallel arrangement and said first end portion has a pair of spaced apertures adapted to receive locking fasteners for non-releasably securing said first and second end portions together.

9. The identification device in accordance with claim 5 wherein said self-imprinting insert means has said micro-encapsulated marking substance on the surface thereof adjacent an inner surface of said open-ended pocket.

10. The identification device in accordance with claim 9 wherein said self-imprinting insert means is provided with a layer of heat sealable material for heat sealable engagement within said open-ended pocket.

11. The identification device in accordance with claim 9 which additionally includes sealing means for sealing said self-imprinting insert means within said open-ended pocket.

* * * * *